United States Patent [19]

Kocher

[11] Patent Number: 4,512,650

[45] Date of Patent: Apr. 23, 1985

[54] FUSER APPARATUS HAVING A UNIFORM HEAT DISTRIBUTION

[75] Inventor: Haribhajan S. Kocher, Penfield, N.Y.

[73] Assignee: Eastman Kodak Company, Rochester, N.Y.

[21] Appl. No.: 548,610

[22] Filed: Nov. 4, 1983

[51] Int. Cl.[3] ..... G03G 15/00

[52] U.S. Cl. ..... 355/3 FU; 165/89; 219/216

[58] Field of Search ..... 355/3 FU, 14 FU; 219/216, 469, 470, 471; 165/89, 120; 432/227, 59

[56] References Cited

U.S. PATENT DOCUMENTS

| | | | |
|---|---|---|---|
| 3,185,816 | 5/1965 | Lusebrink | 165/89 |
| 3,305,005 | 2/1967 | Grover et al. | 165/105 |
| 3,431,396 | 3/1969 | Kodaira | 219/326 |
| 3,435,889 | 4/1969 | Bienert | 165/105 |
| 3,952,798 | 4/1976 | Jacobson et al. | 165/105 |
| 4,064,933 | 12/1977 | Schuman | 165/89 |
| 4,079,227 | 3/1978 | Takiguchi | 219/216 |
| 4,091,264 | 5/1978 | Sarcia | 219/469 |
| 4,147,501 | 4/1979 | Goshima et al. | 432/60 |
| 4,284,875 | 8/1981 | Namiki et al. | 219/216 |

FOREIGN PATENT DOCUMENTS

| | | | |
|---|---|---|---|
| 116934 | 11/1979 | Japan | 355/3 FU |

*Primary Examiner*—A. T. Grimley
*Assistant Examiner*—David Warren
*Attorney, Agent, or Firm*—William F. Noval

[57] ABSTRACT

Fuser apparatus includes a heated fuser member, such as a fuser roller, for fusing a toner image carried by a support moved into contact with the member at a fusing region. The apparatus includes an assembly located in advance of the fusing region and external to the fuser member for maintaining the temperature of the fuser member at the fusing region substantially uniform along the length thereof by redistributing heat from hotter regions to colder regions along the length of the member. The assembly preferably includes a heat pipe which engages the fuser member in advance of the fusing region. The heat pipe may also apply release material to the fuser member and be heated to heat the fuser member.

10 Claims, 5 Drawing Figures

FIG. 1
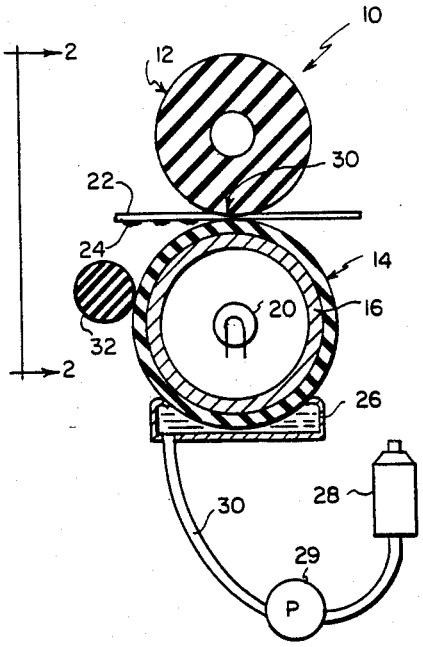
FIG. 2
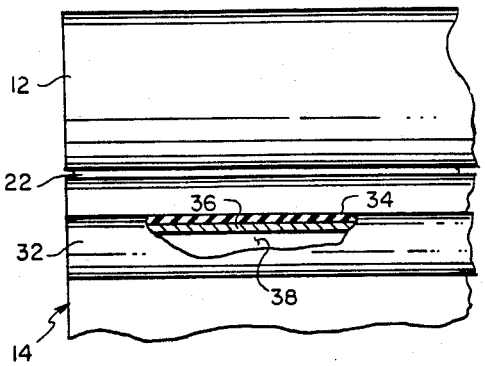
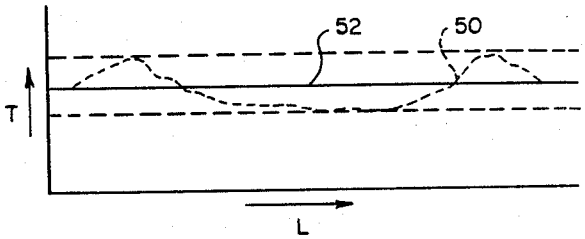
FIG. 3
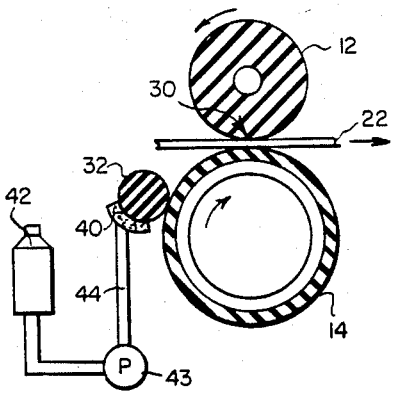
FIG. 4
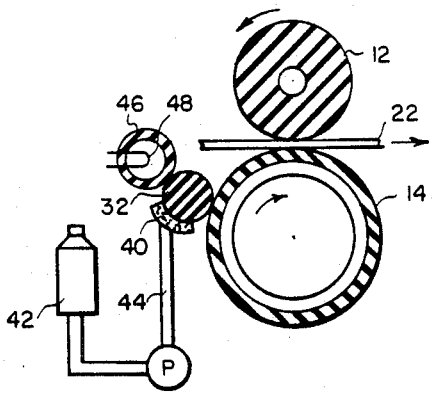
FIG. 5

FUSER APPARATUS HAVING A UNIFORM HEAT DISTRIBUTION

BACKGROUND OF THE INVENTION

This invention relates in general to electrography and apparatus for fusing toner images carried by supports through the application of heat and pressure. More particularly this invention relates to fuser apparatus including a heated fusing member in which the temperature of said fuser member in a fusing region is maintained substantially uniform along the length thereof.

In the electrographic process, a toner image of fusible particles corresponding to an original is formed on a support such as a copy sheet. The toner image is permanently fixed to the support by means of fuser apparatus including a fuser member, such as a fuser roller or belt, which contacts a support carrying a toner image to fuse the toner image to the support by means of heat and pressure. The fusing surface of the fuser member is preferably formed of a material, such as silicone elastomer, exhibiting good release characteristics and exhibiting resistance to degradation at high temperatures. The fuser roller may be heated by an internal heat source such as a quartz lamp positioned within the roller. It has been found that the temperature distribution across the length of the fuser roller at its fusing surface is generally nonuniform in the fusing region of the roller. This nonuniformity is a function of fuser lamp length, the pattern of heat radiation distribution along the length of the lamp, loss of heat to the bearings and structural members which support the fuser roller, nonuniform heat conductance through the fuser roller due to lenth of supports being fused, etc.

In reproduction machines in which heat-sensitive copy sheets are developed, it has been proposed to provide and maintain a uniform temperature across the outer surface of a heated cylinder. Thus in U.S. Pat. No. 4,064,933 issued Dec. 27, 1977 for "Developing Roller Apparatus For Reproduction Machines", patentee G. A. Schuman, a heated developing roller is disclosed which includes a hollow thin-walled heat conducting rotatable cylinder having relatively small diameter heat pipes mounted on or embedded in its inner wall and extending substantially between the ends of the cylinder. Such a cylinder is disadvantageous due to the complexity and expense of manufacturing a cylinder with the heat pipe integral with or welded to the internal surface thereof. In U.S. Pat. No. 3,952,798, issued Apr. 27, 1976, for "Internally Heated Heat Pipe Roller," patentees D. L. Jacobson et al., there is disclosed a heat pipe which is used as a fusing roller for affixing a powdered image to a support surface or as a device for heating the fusing roller. The disclosed heat pipe is internally heated and presents difficulties in manufacture and complexity in structure. U.S. Pat. No. 4,284,875 issued Aug. 18, 1981, for "Heat Roller Fixing Apparatus," patentees R. Namiki et al, also discloses a complex internally heated heat pipe which may be used as a fixing apparatus in a copier.

It would thus be desirable to provide fuser apparatus having a heated fusing member where the temperature across the length of the fusing member in its fusing region is substantially uniform while at the same time providing a simple, efficient and inexpensive assembly for effecting such uniformity. Improvement in temperature uniformity will be helpful in improving the life of an elastomeric fuser roller and in increasing the range of temperatures over which fusing may be effected.

SUMMARY OF THE INVENTION

According to the present invention, there is provided fuser apparatus including a movable heated fuser member for fusing a toner image carried on a support moved into contact with the member at a fusing region and means located in advance of said fusing region and external to said fuser member for maintaining the temperature of said fusing member substantially uniform along the length thereof by redistributing heat from hotter regions to cooler regions of the member. The temperature maintaining means preferably comprises a heat pipe engaging the fuser member in advance of the fusing region. The heat pipe may also be supplied with release material for application to the fuser roller. According to another aspect of the invention, the heat pipe may be heated by means of an external heat source to provide heat to the fuser member.

The invention and its objects and advantages will become more apparent in the detailed description of the preferred embodiment presented below.

BRIEF DESCRIPTION OF THE DRAWINGS

In the detailed description of the preferred embodiment of the invention presented below, reference is made to the accompanying drawings, like elements having like numbers in which FIG. 1 is a partially cross-sectional side elevational view of fuser apparatus including one embodiment according to the present invention.

FIG. 2 is a partially sectional, front elevational view taken along line 2—2 of FIG. 1.

FIG. 3 is a graph illustrating the temperature along the length of the fuser roller of FIG. 1.

FIG. 4 is a diagrammatic, elevational view of another embodiment of the present invention and FIG. 5 is a diagrammatic, elevational view of a further embodiment of the present invention.

DESCRIPTION OF THE PREFERRED EMBODIMENTS

The fuser apparatus according to the present invention is adapted to be used in electrographic apparatus such as that shown and described in commonly assigned U.S. Pat. No. 3,914,047. As disclosed therein, an endless photoconductive member is moved around a path past various work stations. The photoconductive member is charged with an electrostatic charge at a charging station and a light image of a document is projected onto the charged photoconductive member to form a latent electrostatic image corresponding to the illuminated document. The electrostatic image is then developed with toner to produce a toner image which is subsequently transferred to a copy sheet brought into contact with the photoconductive member at a transfer station. The copy sheet carrying the unfused toner image is separated from the photoconductive member and passed through the nip of a pair of fuser rollers to permanently fuse the toner image to the copy sheet which is then transported to an output tray.

Referring now to FIGS. 1 and 2, there is shown a fuser apparatus including an embodiment of the present invention. As shown, fuser apparatus 10 includes a pressure roller 12 and a fuser roller 14 having a cylindrical core 16 of heat-conductive material such as aluminum and a fusing layer 18 of high-temperature resistant material having good release properties such as silicone elastomer. Roller 14 is heated by means of an internal heater element such as a quartz lamp 20. Rollers 12 and 14 form a heated fusing region in the nip for fusing a support such as copy sheet 22 carrying an unfused toner image 24 passed through the nip. In order to enhance the release properties of fusing layer 18 to prevent toner and other debris from sticking to it, a release material such as silicone oil is applied to roller 14 by applicator 26 which is supplied release material from a source such as container 28 by means of pump 29 and conduit 30.

Fuser rollers used in commercial fuser apparatus have exhibited non-uniformity of temperature distribution across the length of the fuser roller. This may be caused by irregularities in the heat flux distribution along the length of the quartz lamp, heat conductance from the lamp and fuser roller to bearings and supporting frame for the roller, differential heat loss in processing of different size papers, etc. Irregularities, such as creasing, in fused supports and image degradation often result from such temperature non-uniformity. The graph of FIG. 3 which plots temperature along the length of a fuser roller illustrates the non-uniformity of roller temperature. Thus, curve 50 shows the temperature of a fuser roller to be non-uniform along its length due to the variables discussed above.

In order to make the temperature more uniform across the length of a fuser roller (e.g., as represented by the straight line curve 52 of FIG. 3), an assembly for redistributing heat from hotter regions to cooler regions across the length of roller 14 is provided. Such assembly preferably comprises a heat pipe 32 which engages roller 14 in advance of fusing nip region 30 formed by rollers 12 and 14. The construction of heat pipe 28 is well known to those skilled in the art and is disclosed for example in the book entitled "Heat Pipes" 2nd Ed. by P. D. Dunn and D. A. Reay, published by Pergamon Press Limited, Headington Hill Hall, Oxford, OX3 OBW, England in 1978. As an example, heat pipe 32 may comprise an enclosed cylinder 34 of heat-conductive material such as copper which has a wick 36 disposed about its inner wall. Wick 36 may, for example, comprise copper mesh material. Wick 36 is saturated with a volatile fluid such as water and surrounds an evacuated chamber 38.

The operation of heat pipe 32 is as follows. When a portion of heat pipe 36 engages a region of fuser roller 14 which is hotter than another region along the length of roller 14, the working fluid in wick 36 evaporates. The vapor then flows from the heated region to the cooler region through evacuated chamber 38. At the cooler region the vapor condenses giving up its heat of evaporation to raise the temperature of the cooler region of the heat pipe and thereby the cooler region of the fuser roller. The condensed fluid then returns to the previously heated region by means of capillary action of the wick. This process will be repeated along the length of the heat pipe to maintain the temperature of the fuser roller substantially uniform across the length thereof (as illustrated by curve 52 in FIG. 3).

Referring now to FIG. 4, there is shown another embodiment of the present invention. As shown, heated fuser roller 14 is engaged by heat pipe 32 in advance of fusing region 30. However, instead of applying release material to roller 14 through a separate applicator, release material is applied to heat pipe 32 which applies it to roller 14. This is effected by an applicator wick 40 in contact with heat pipe 32 which is supplied release material such as silicone fuser oil from a supply such as bottle 42 by means of pump 43 and conduit 44. By combining the maintenance of uniform temperature across the length of the fuser roller and the application of release material into a single assembly, the fuser apparatus is simplified and control of fusing temperature and application of release material may be effected as close to the fusing region as is desirable.

Referring now to FIG. 5, there is illustrated a further embodiment of the present invention. Instead of smoothing out the non-uniform temperature of an already heated fuser roller, heat pipe 32 is used to supply a uniform temperature to fuser roller 14 just in advance of fusing region 30. This reduces the energy requirements of fuser apparatus 10 since only a portion of roller 14 is heated instead of its entirety. Heat pipe 32 also applies release material to roller 14. Thus heat pipe 32 is supplied with release material by means of wick 40 supplied from fuser oil supply 42 by means of pump 43 and conduit 44 as in the embodiment of FIG. 4. In addition, however, a roller 46 internally heated by lamp 48 heats heat pipe 32 which heats roller 14 just in advance of the fusing region 30 thereof in order to effect maximum efficiency of the fuser apparatus 10.

Thus, it is seen that there is provided improved fuser apparatus in which a heated fuser member is maintained at a uniform temperature across the length of the member in advance of the fusing region in which a toner image carrying support contacts the fuser member so that images are fused uniformly across the length of the support thus resulting in improved image quality. Moreover, a simplified fuser apparatus is provided by utilizing a heat pipe not only to maintain the temperature of a heated fuser member constant across the length of the member in advance of the fusing region but also to apply release material to the fuser member. In addition, the heat pipe may be used to heat the fuser member thus obviating the necessity for an internal heater and further simplifing the mechanisms of the fuser apparatus.

The invention has been described in detail with particular reference to preferred embodiments thereof. However, it will be understood that variations and modifications can be effected within the spirit and scope of the invention.

What is claimed is:

1. Fuser apparatus comprising:

a movable heated fuser member for fusing a toner image carried by a support moved into contact with the member at a fusing region; and means for maintaining the temperature of said fusing member substantially uniform along the length thereof by redistributing heat from hotter regions to cooler regions of the member, said temperature maintaining means being located in advance of said fusing region relative to the direction of support movement, and said temperature maintaining means being in engagement with said fuser member and movable relative to the fuser member.

2. The fuser apparatus of claim 1 wherein said temperature maintaining means includes a heat pipe engaging said fusing member in advance of said fusing region.

3. The fuser apparatus of claim 2 including means for supplying release material to said heat pipe and wherein said heat pipe applies said release material to said fuser member.

4. The fuser apparatus of claim 1 wherein said fuser member is a roller having an elastomeric layer which contacts said support and including a heat source located inside said roller for heating said elastomer layer.

5. Fuser apparatus comprising:

a first roller which is heated, said first roller having an external fusing surface;

a second roller, said first and second rollers forming a nip for fusing toner image carrying supports moved through said nip; and means for maintaining the temperature of said first roller substantially uniform along the length thereof at least in the region of said nip by redistributing heat from hotter regions to cooler regions of the roller, said temperature maintaining means being located external to said first roller and in advance of said nip relative to the direction of support movement, and said temperature maintaining means being in thermal contact with the external fusing surface of said first roller.

6. The fuser apparatus of claim 5 including a heater element located internally of said first roller for heating said roller.

7. The fuser apparatus of claim 5 wherein said temperature maintaining means includes an externally located heat pipe engaging said first roller in advance of the nip between said first and second rollers.

8. The fuser apparatus of claim 7 including means for supplying release material to said heat pipe and wherein said heat pipe applies said release material to said first roller.

9. The fuser apparatus of claim 7 wherein said heat pipe is heated by external means and wherein said first roller is heated by said heat pipe.

10. The fuser apparatus of claim 9 including means for supplying release material to said heat pipe and wherein said heat pipe applies said release material to said first roller.

* * * * *